US005937955A

United States Patent [19]

Nims et al.

[11] Patent Number: 5,937,955

[45] Date of Patent: Aug. 17, 1999

[54] METHOD AND APPARATUS FOR SEALING A WELL BORE AND SIDETRACKING A WELL FROM THE WELL BORE

[75] Inventors: David G. Nims; Daniel S. Stoltz, both of Anchorage, Ak.

[73] Assignees: Atlantic Richfield Co., Los Angeles, Calif.; BP Exploration Alaska, Inc., Anchorage, Ak.

[21] Appl. No.: 08/864,491

[22] Filed: May 28, 1997

[51] Int. Cl.[6] ..... E21B 7/04

[52] U.S. Cl. ..... 175/61; 166/50; 166/241.1

[58] Field of Search ..... 175/61; 166/50, 166/117.6, 241.1, 55, 298, 277, 376

[56] References Cited

U.S. PATENT DOCUMENTS

| | | | |
|---|---|---|---|
| 2,155,129 | 4/1939 | Hall et al. | 166/376 |
| 2,173,035 | 9/1939 | Armentrout et al. | 166/381 |
| 2,207,345 | 7/1940 | Hammer | 166/376 |
| 2,284,969 | 6/1942 | Adkison | 166/376 |
| 2,436,198 | 2/1948 | Cardwell et al. | 166/376 |
| 4,890,675 | 1/1990 | Dew | 175/61 |
| 5,564,503 | 10/1996 | Longbottom et al. | 166/313 |

*Primary Examiner*—Hoang C. Dang
*Attorney, Agent, or Firm*—F. Lindsey Scott

[57] ABSTRACT

A method and apparatus for sealing a pilot well and directionally drilling a directional well from the pilot well by the use of a casing including an easily drillable section positioned through a selected zone.

9 Claims, 3 Drawing Sheets

METHOD AND APPARATUS FOR SEALING A WELL BORE AND SIDETRACKING A WELL FROM THE WELL BORE

BACKGROUND OF THE INVENTION

1. Field of the Invention

This invention relates to a method and apparatus for sealing a well bore by cementing and the like and sidetracking a well from the well bore.

2. Brief Description of Prior Art

Frequently in oil field operations it is necessary to drill wells referred to as "pilot wells" to determine formation properties, formation depths and thicknesses and the like.

These wells may be drilled either as slanted or vertical wells to obtain geologic information prior to drilling a horizontal or other well into a formation of interest. The pilot well permits logging to determine the geologic location of a formation(s) of interest so that the horizontal well can be drilled into a selected location in the formation of interest. Pilot wells may also be used for obtaining information about subterranean formations for use with other types of wells.

Generally, the pilot well is logged to determine the depth and thickness of the various formations penetrated by the pilot well. In the event that the pilot well is not used for production or otherwise it is necessary to plug the pilot well to seal the subterranean formations so that materials from the subterranean formations do not escape to the surface or commingle. This sealing is usually accomplished by cementing the well bore shut. Conventional methods for sealing the well bore involve numerous trips of drill string into the well to complete the cementing operation. As a result the well bore is unavailable for future production and wells for production of fluids based upon the data obtained from the pilot well are drilled to produce fluids from the formation.

Even when the pilot well is used to drill a sidetracked well it is necessary to make numerous trips into the well to complete the cementing operation using conventional methods. Further, it is necessary to make additional trips into the well to place a wedge or other "kickoff" device in the well to enable a drill bit to drill through the hard steel casing when the well has been cased. Alternatively techniques such as milling or the like to open a window in the casing may be used. As a result, the use of such pilot wells for sidetracking is expensive and in many instances these wells are simply abandoned by plugging.

It would be economically desirable to be able to salvage any cased portion of the pilot well and the well bore for use in drilling a sidetracked well. Accordingly, considerable effort has been directed to development of improved and more economical methods and apparatus for sealing the unused portion of a well bore and sidetracking a well from the well bore.

SUMMARY OF THE INVENTION

According to the present invention a well bore is sealed and a sidetracked well is drilled from the well bore by method comprising: drilling a well bore from a surface through a subterranean zone of interest; positioning a casing including an easily drillable casing section fabricated of a material having a hardness less than 50% of the hardness of steel in the well bore so that the easily drillable casing section is positioned through a selected zone; Filling the well bore and the casing with cement to a level above the selected zone; and directionally drilling a sidetracked well from the well bore through the easily drillable casing section.

The present invention also comprises an apparatus for cementing a well bore and positioning an easily drillable casing section through a selected zone, the apparatus comprising a casing extending from a surface to a depth above the selected zone and an easily drillable casing section positioned in fluid communication with the casing and through the selected zone. The apparatus may also include a reduced diameter section positioned in fluid communication with a lower end of the easily drillable casing section and a lower portion of the well bore.

BRIEF DESCRIPTION OF THE DRAWINGS

The present invention is further described and explained in relation to the following figures of the drawings wherein.

DESCRIPTION OF THE PREFERRED EMBODIMENTS

In the description of the FIGURES the same numbers will be used throughout to refer to the same or similar components. Various other components known to the art such as wellheads, drilling components and the like have not been shown.

Figure 1:
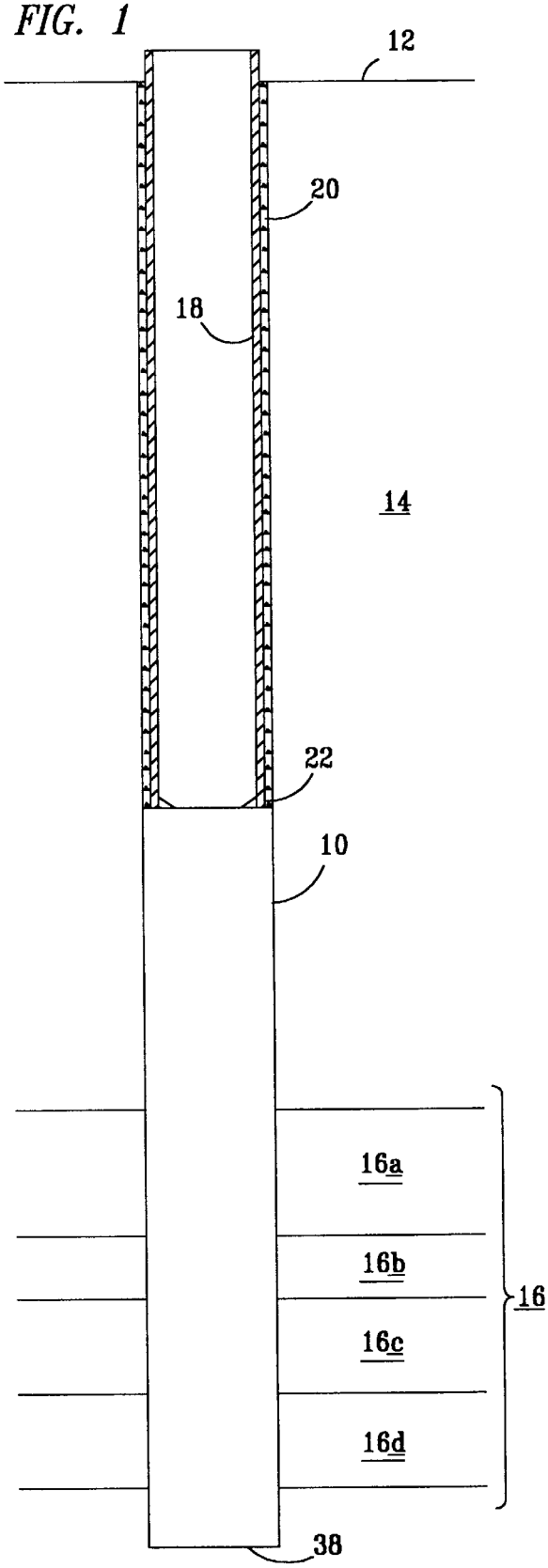
FIG. 1 is a cross-sectional view of a partially cased pilot well penetrating a plurality of subterranean formations.

In FIG. 1 a well bore 10 is shown extending from a surface 12 through an overburden 14 to penetrate a subterranean formation 16 comprising a plurality of zones 16*a,* 16*b,* 16*c* and 16*d.* Zones 16*a,* 16*b,* 16*c* and 16*d* are frequently oil, water or gas bearing zones which are desirably logged to enable the drilling of wells to effectively produce fluids from the desired zones. Frequently, in the drilling process an upper portion of well 10 is cased by a casing 18 which is cemented in place with cement 20 as a part of the drilling operation. Typically, casing 18 includes a hanger 22 for positioning smaller diameter casing sections to extend to greater depths in the earth. Alternatively, if the well is a relatively shallow well the well could be drilled to its total depth as an "open hole" well and thereafter cased to its total depth with a single diameter casing. In the event that it is desirable to do so a sidetracked well could be used as wellbore 10. It may be desirable to use a sidetracked well as the pilot well in the event that drilling or other problems require the abandonment of the lower portion of a pilot well or the like.

Figure 2:
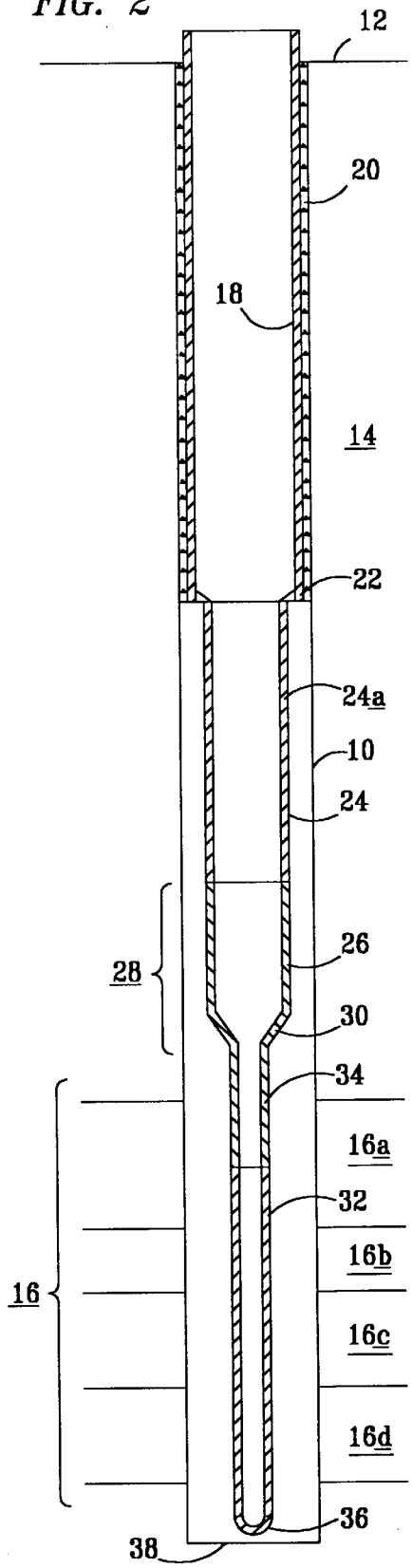
FIG. 2 is a cross-sectional view of the apparatus of the present invention in position in the well of FIG. 1 for use in cementing the well bore.

In FIG. 2 an embodiment of the present invention is shown. A second casing 24 is shown supported from casing hanger 22 and includes a conventional steel casing section 24*a* in fluid communication with an easily drillable casing section 26.

Section 26 is desirably formed to join upper casing section 24 as one or more casing sections and is fabricated of an easily drillable material having a hardness less than about 50% of the hardness of the steel casing and desirably less than about 20% of the hardness of the steel casing. Some suitable materials are aluminum, aluminum alloys, fiberglass, ceramic composites, metallic alloys and plastics such as polyvinyl chloride or polystyrene.

The easily drillable material must have suitable strength to function as a portion of the casing during well completion and cementing operations. Desirably, the apparatus of the present invention as shown in FIG. 2 includes a crossover 30 which is a reducing section between casing 26 and a tubing 32.

Tubing 32 desirably includes an upper section 34 positioned in fluid communication with crossover 30. The lower portion of tubing 32 extends to near a bottom 38 of well bore 10 and includes at its lower end a cement distribution fitting 36, commonly referred to as a "mule shoe."

Figure 3:
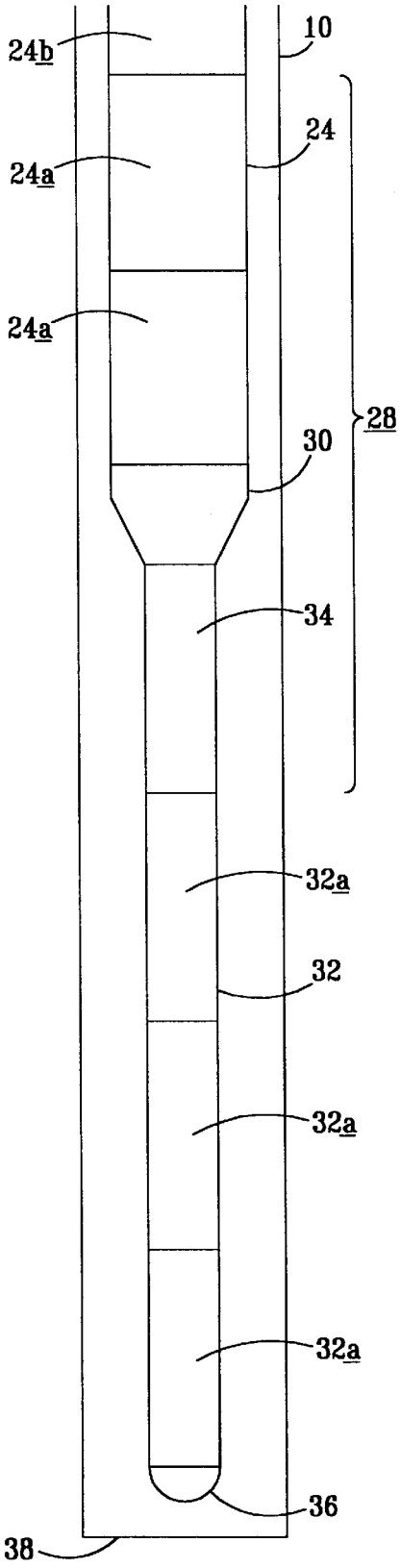
FIG. 3 is an expanded view of the apparatus of the present invention in position in the well bore.

FIG. 3 is an expanded view of the apparatus of the present invention in position through the selected zone.

Casing 24 comprises a plurality of sections. The sections are generally 20 feet in length and are positioned in the well bore as known to those skilled in the art. According to the present invention one or more easily drillable sections 24*a* are positioned in casing 24 to extend through a selected zone 28. Desirably, crossover 30 and an upper section 34 of tubing 32 are fabricated of the easily drillable material. The lower sections 32*a* of tubing string 32 can be used steel pipe or the like since these sections will be subsequently cemented in place and left in the well bore.

Figure 4:
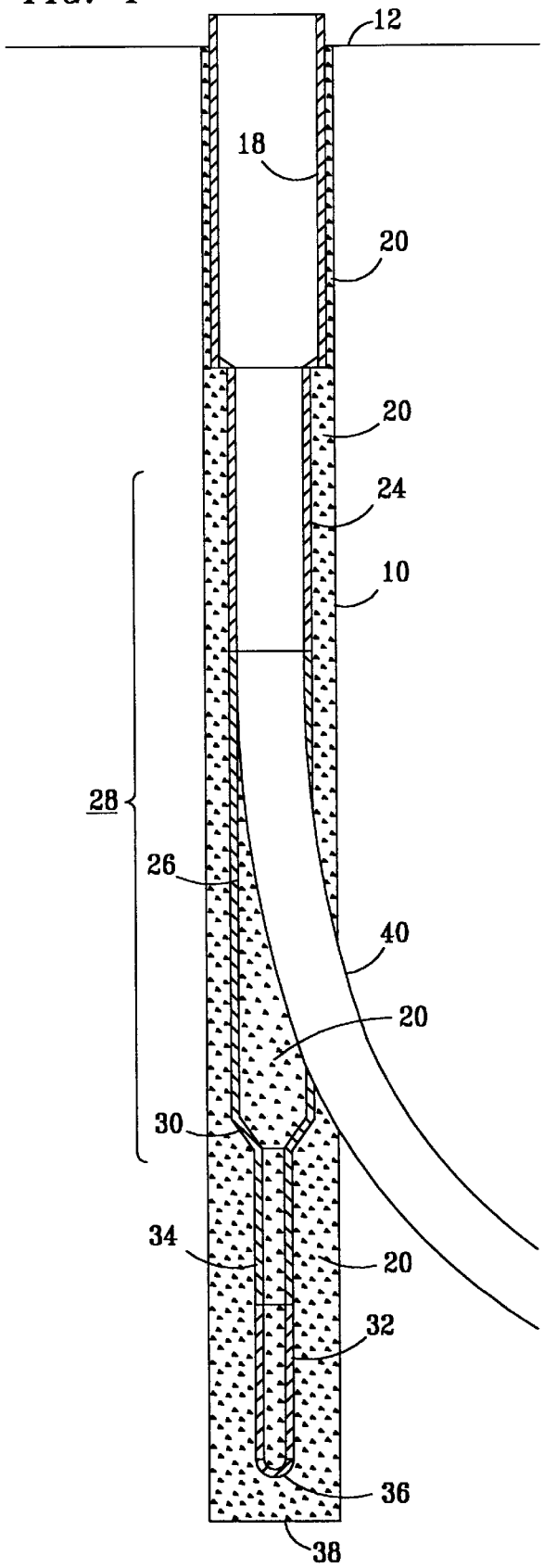
FIG. 4 shows the apparatus of the present invention cemented in a well bore from which a sidetracked well has been drilled.

According to the present invention, the pilot well bore 10 is cemented shut and the well is equipped for sidetracking a second well bore from well bore 10. In FIG. 4 a sidetracked well bore 40 is shown extending from well 10. In FIG. 4 the apparatus of the present invention has been cemented in place to close formation 16 in well bore 10.

Well bore 10 is cemented closed to a selected level and the annulus between the outside of the casing and the inside of the well bore may be cemented to surface 12. Desirably, cement is left in casing 24 to a height above selected zone 28. Conventional, directional drilling techniques are then used to direct a drill through the wall of casing 24 in the easily drillable section which is readily penetrated by the drill as it drills downwardly through the cement left in casing 24. The net result is that well bore 10 has been cemented shut in its lower portion closing subterranean formation 16 and the sidetracked well can be drilled using conventional directional drilling equipment.

The use of well bore 10 and the casing already positioned in well bore 10 to drill sidetracked well 40 achieves significant economies. Further, the use of the apparatus of the present invention results in a single trip into the well bore which greatly reduces operating expense.

More specifically, by the method of the present invention well bore 10 is drilled from surface 12 through subterranean zone 16. The well may then be logged and thereafter casing 24 including easily drillable section 26 is positioned through selected zone 28. The well bore and casing are then filled with cement to a level above the selected zone and well bore 40 is directionally drilled from well bore 10 through easily drillable casing section 26.

The annular space outside casing 24 and casing 18 may be filled with cement to a desired level above the top of selected zone 28.

Figure 5:
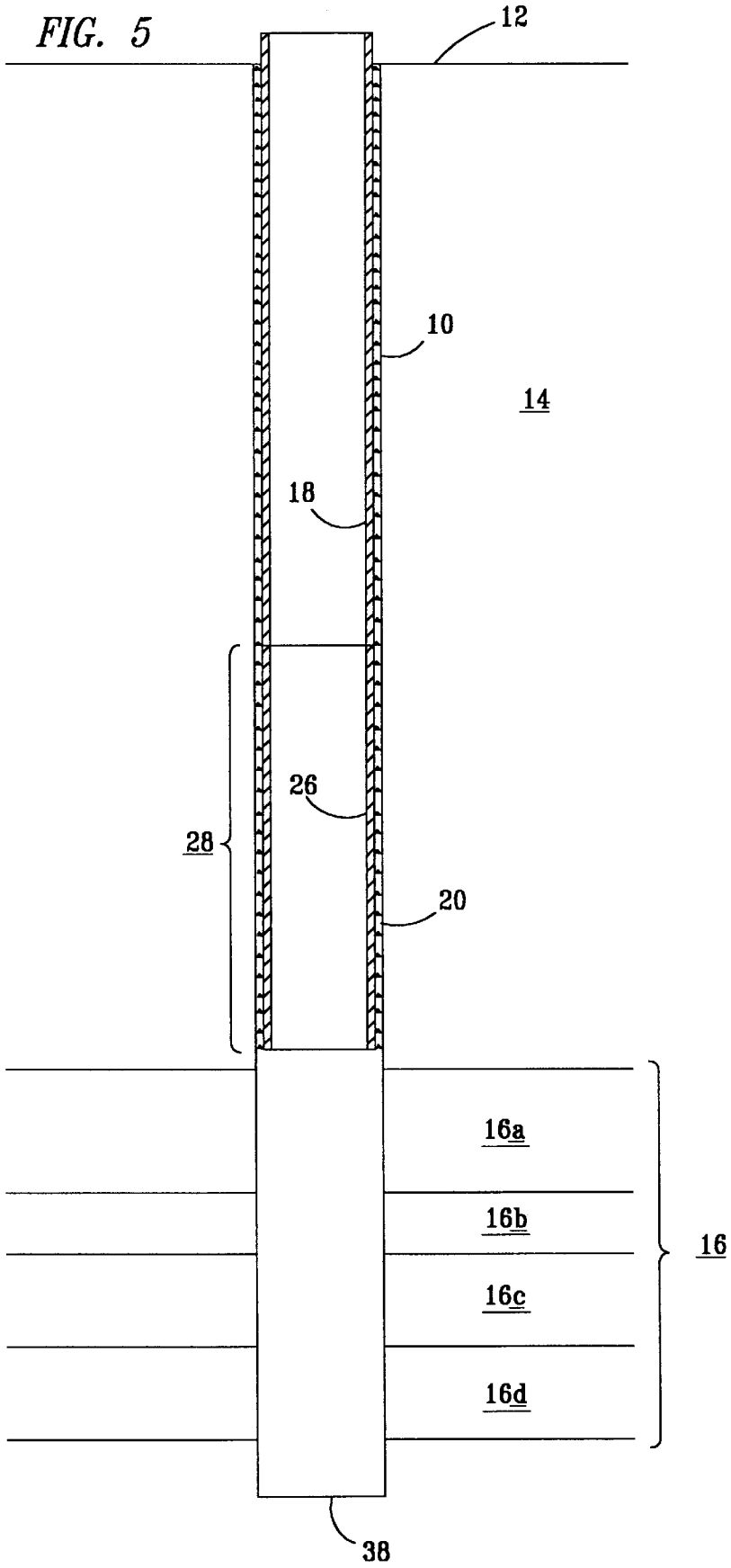
FIG. 5 is a cross-sectional view of an alternate embodiment of the present invention.

In FIG. 5 an alternate embodiment of the present invention is shown. In the embodiment shown in FIG. 5, casing 18 is positioned in well bore 10 through selected zone 28. Upon completion of logging operations in formation 16 the well is cemented shut by simply pumping cement into the inside of the casing until cement has filled the lower portion of well bore 10 and extends upwardly to a selected height in the annulus between the outside of casing 26 and the inside of well bore 10. Desirably, cement is left in casing 18 to a height above selected zone 28. The drilling of well bore 40 is then accomplished as described in connection with FIG. 4. The embodiment of the invention shown in FIG. 3 is preferred since it permits much more precise cement placement and is considered to result in more effective cement closure of formation 16.

The practice of the present invention eliminates expensive multiple trips into a well bore with tubing and the like to accomplish sidetracking and cementing of a well bore. The upper sections of the sidetracked well bore are used thereby eliminating expensive redrilling operations necessary when the entire pilot well is discarded. The method of the present invention also results in greater geological precision in drilling operations since the pilot hole used to determine the location of the geologic formations of interest is used to drill the sidetracked well into the geologic formation of interest becomes a part of the sidetracked well. The entry of the sidetracked well into the geologic formation of interest is much nearer the pilot well used to determine the geologic location of such formations. According to the present invention an improved method is provided which effectively closes the unwanted portion of a pilot well and permits the economical drilling of a sidetracked well from the pilot well. The present invention also provides efficient and economical apparatus for accomplishing the desired operations.

Having thus described the present invention by reference to certain of its preferred embodiments it is noted that the embodiments disclosed are illustrative rather than limiting and that many variations and modifications are possible within the scope of the present invention. Many such variations and modifications may be considered obvious and desirable by those skilled in the art based upon a review of the foregoing description of preferred embodiments.

We claim:

1. A method for sealing an at least partially cased pilot well and directionally drilling a directional well from the pilot well, the method comprising:

a. drilling the pilot well from a surface through a subterranean zone of interest;

b. positioning a casing including an easily drillable casing section fabricated of a material having a hardness less than 50% of the hardness of steel in the pilot well so that the easily drillable casing section is positioned through a selected zone;

c. filling the pilot well and the casing with cement from its bottom to a level above the selected zone; and d. directionally drilling a directional well from the pilot well through the easily drillable casing section without using a whipstock.

2. The method of claim 1 wherein the subterranean zone of interest includes at least one zone containing water, gas or hydrocarbonaceous liquids.

3. The method of claim 1 wherein the casing is in fluid communication with a tubing positioned beneath a lower end of the casing and extending to near a bottom of the pilot well and the cement is injected into the pilot well through the casing and the tubing.

4. The method of claim 1 wherein the easily drillable casing section has a hardness less than about 20% of the hardness of steel.

5. The method of claim 1 wherein the easily drillable casing section is fabricated of a material selected from the group consisting of aluminum, aluminum alloys, fiberglass, ceramic composites, metallic alloys, and plastics.

6. The method of claim 1 wherein the easily drillable casing section is fabricated of aluminum or an aluminum alloy.

7. The method of claim 5 wherein the easily drillable casing section is fabricated of polyvinyl chloride plastic or polystyrene plastic.

8. The method of claim 1 wherein the annular space between an outside of the casing and an inside of the pilot well is filled with cement to a selected height.

9. The method of claim 1 wherein the pilot well is a sidetracked wellbore.

* * * * *